US006738317B2

(12) United States Patent
Nussbaum

(10) Patent No.: US 6,738,317 B2
(45) Date of Patent: May 18, 2004

(54) WRISTWATCH WITH A REVERSIBLE CASE

(75) Inventor: Augustin Nussbaum, Gals (CH)

(73) Assignee: The Swatch Group Management Services, Biel (CH)

( * ) Notice: Subject to any disclaimer, the term of this patent is extended or adjusted under 35 U.S.C. 154(b) by 265 days.

(21) Appl. No.: 09/950,707

(22) Filed: Sep. 13, 2001

(65) Prior Publication Data

US 2002/0031053 A1 Mar. 14, 2002

(30) Foreign Application Priority Data

Sep. 14, 2000 (CH) ..... 1783/00

(51) Int. Cl.[7] ..... G04B 37/00; A44C 5/00
(52) U.S. Cl. ..... 368/88; 368/281; 368/309
(58) Field of Search ..... 368/88, 276, 277, 368/281–282, 294–296, 309, 308

(56) References Cited

U.S. PATENT DOCUMENTS 4,236,239 A * 11/1980 Imgruth et al. ..... 368/72
4,493,561 A * 1/1985 Bouchet ..... 368/281
5,479,381 A * 12/1995 Goldenberg et al. ..... 368/282

FOREIGN PATENT DOCUMENTS

WO 86 06511 11/1986

* cited by examiner

*Primary Examiner*—Vit W. Miska
(74) *Attorney, Agent, or Firm*—Sughrue Mion, PLLC

(57) ABSTRACT

There is disclosed a wristwatch (1) whose wristband (6) is attached to a support (3) with respect to which the case (2) can turn over to show one or other of its faces (16, 17). The support (3) includes, on the parallel inner surfaces (9) of its flanges (7), grooves (10) in which snugs (39) connected to the case can slide and pivot. Stops are provided in the grooves (10), to stop the case sliding after a first sliding travel of the snugs (39) from the ends (42) of the grooves, to define a pivoting zone of the case, before the snugs effect a second sliding travel to the other ends (42). Support surfaces (11) and a transverse recess (12) are provided on the bottom (4) of the support to prevent the case turning over except in the zone of the stops.

20 Claims, 6 Drawing Sheets

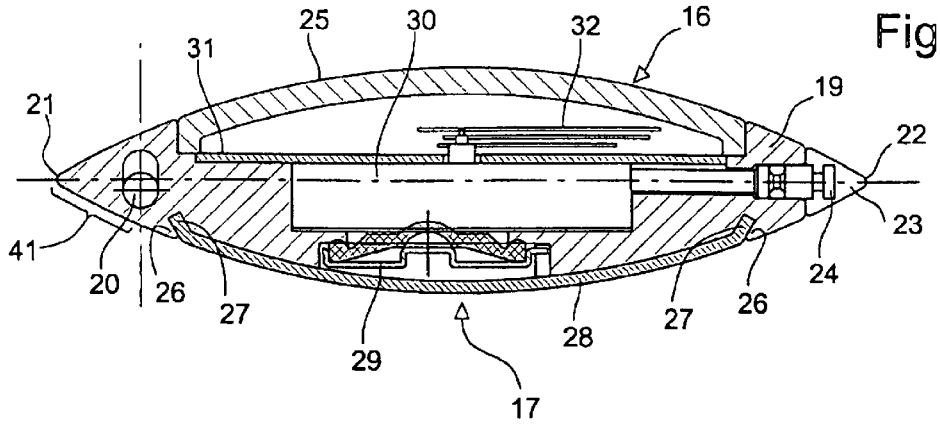
Fig. 7
Fig. 8
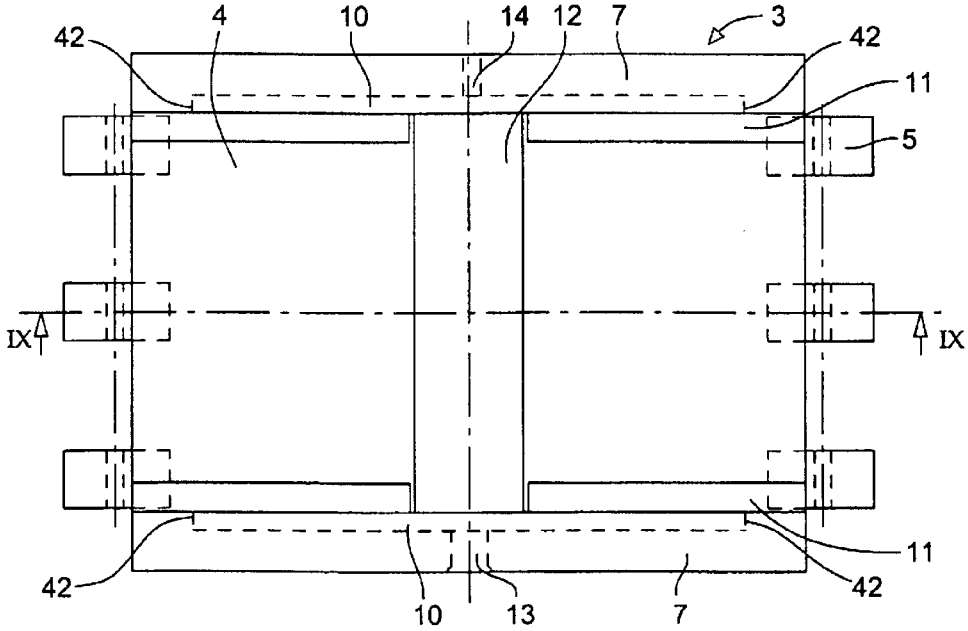

WRISTWATCH WITH A REVERSIBLE CASE

The present invention concerns a wristwatch including a support attached to a wristband and a case containing a clockwork movement and display means, the case being mounted on the support so as to be able to slide and turn over to show respectively one or other of its faces in two operating positions, the watch including means for holding the case in its two operating positions, the support comprising two parallel inner surfaces each including a longitudinal groove closed at its ends, the case including, facing said inner surfaces, two parallel lateral walls each having a snug able to slide in the corresponding groove of the support, each of the grooves including at least one stop, disposed at a distance from its ends, the effect of said stop being to define a stop zone for the case, after a first sliding travel of the snug from one end of the groove, to let said case turn over, before said snug performs a second sliding travel to the other end of the groove.

A wristwatch of this type has been known for a long time. Additional Certificate No. 41 060 to French Patent No. 712 868 granted on Aug. 3, 1931 shows different variants. In a first variant, the watch case is free to pivot, to turn over on itself, at any place on the support. In another variant, this pivoting freedom is restricted. Indeed, the arrangement of the mechanism is such that the case can only pivot and turn over at the ends of the support, recesses being provided for this purpose.

However, these embodiments have a major drawback in common. The manufacturer of such watches can choose to favour ease of handling of the mechanism, in which case he will not use too hard a spring to hold the case in its operating positions, in order to make the latter easier to release. In such case, the mechanism will be made too sensitive to abrupt movements by the user's wrist, said movements being able to cause the case to pivot inadvertently. In order to overcome this drawback, the manufacturer may choose to use springs of greater hardness, in which case it becomes difficult to handle the mechanism and the mechanical parts are exposed to premature wear.

The object of the present invention is to improve watches of this type so as to avoid the aforecited drawbacks.

The invention therefore provides a wristwatch of the type indicated hereinbefore, characterised in that it further includes means for preventing the case from pivoting outside said stop zone and thus said stop zone being a pivoting zone.

In a particular embodiment, said means for preventing the case pivoting outside said pivoting zone may be formed by at least one guide surface on the support, against which a surface of the case can abut by sliding.

One may also provide, in each groove, a recess located facing the stop, to allow the corresponding snug to get over the latter. One may, in this embodiment, use other means, such as the use of snugs of elongated cross-section, of greater length than the height of the groove, so that they can only pivot in the pivoting zone defined by the position of the stop and in which sufficient space is provided.

The case will thus pivot exclusively in the pivoting zone at a distance from the ends, removing any risk of inadvertent pivoting connected to an abrupt movement of the wrist.

In a preferred embodiment including said guide surface on the support, each groove may be formed of two successive sections, substantially parallel to the guide surface, and located at different distances from the latter, thus defining a high section and a low section, said sections being connected by a vertical break. In particular, the snugs of the case can be offset with respect to each other in height, said grooves being placed such that the high section of one is opposite the low section of the other and vice versa.

The invention will be better understood from the following description of different embodiment examples with reference to the annexed drawings, in which:

FIG. 7 is a cross-section of the watch case of FIG. 1, along its vertical median symmetrical plane;

FIG. 8 is a top view of the support of the watch of FIG. 1;

Figure 1:
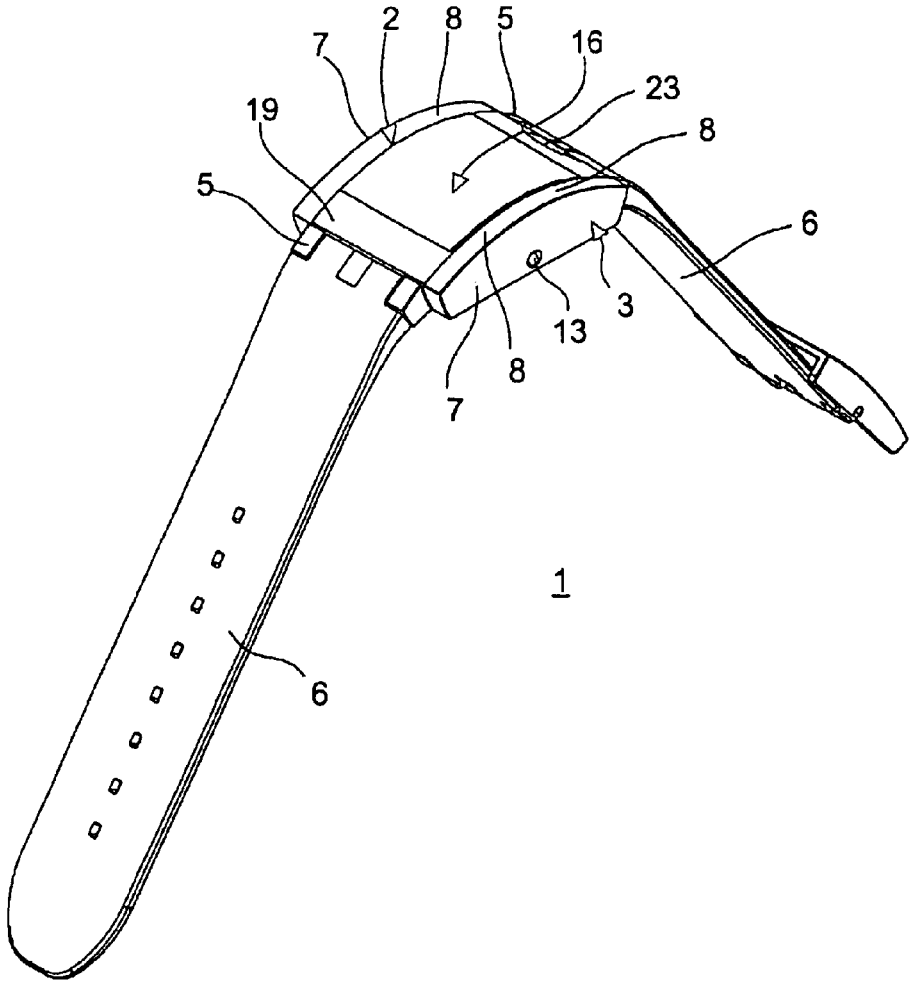
FIG. 1 is a perspective view of a preferred embodiment of a wristwatch according to the invention, in one of the two operating positions.
Figure 2:
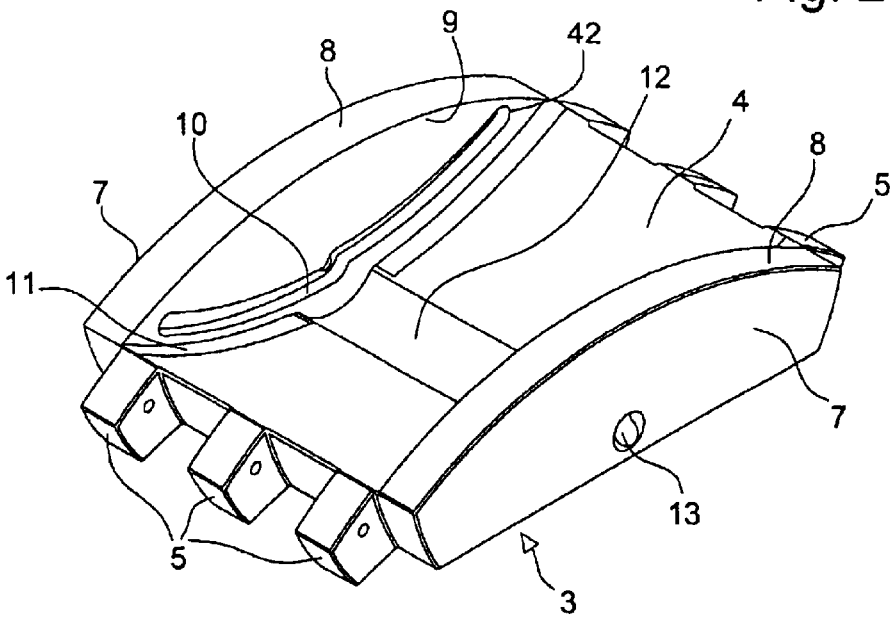
FIG. 2 is a perspective view of the support of the watch of FIG. 1.
Figure 3:
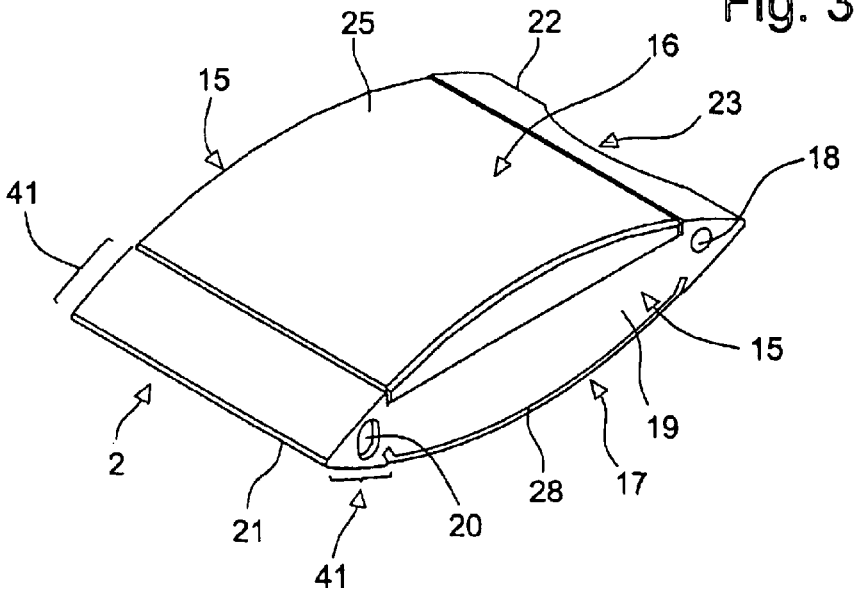
FIG. 3 is a perspective view of the case of the watch of FIG. 1.

FIGS. 1 to 6 illustrate the general appearance of wristwatch 1, according to the preferred embodiment, and the movement effected by case 2 when it slides and turns over with respect to support 3.

Support 3 includes a bottom 4 the upper part of which is concave and from which project horns 5, to which wristband 6 is secured, and lateral flanges 7 parallel to the direction of wristband 6. Each of these lateral flanges 7 has an upper edge 8 of rounded shape, a maximum height at its middle and an inner surface 9 including a longitudinal groove 10.

Bottom 4 of support 3 includes longitudinal guide surfaces 11, which are also visible in FIG. 8, extending from the ends of the support to its central region, in which there is a rounded transverse recess 12 delimited on either side by flanges 7. The latter further include holes 13 and 14 which pass through them substantially midway from the longitudinal ends of the support, and which open into the corresponding groove 10.

In this embodiment, the case has a general spindle shape in its longitudinal direction which corresponds to the direction of the wristband, its lateral walls 15 being substantially plane and parallel, thus delimiting two convex faces 16 and 17 of substantially complementary shape to that of bottom 4 of the support. In a preferred variant, faces 16, 17 of the case and bottom 4 of the support each have a profile in the arc of a circle.

Each of lateral walls 15 includes a small projecting element 18 located on middle part 19 of the case and preferably having substantially the shape of a portion of a sphere. Projecting element 18 could be made to be retractable into the case by using resilient means which are not shown. A hole 20 passes through middle part 19 in proximity to an end 21 of the spindle. At its other end 23 it includes a recess 22 in the portion thereof accommodating the time-setting crown 24, said crown having a flattened shape to avoid projecting from the upper and lower faces of the case.

As is seen more clearly in FIG. 7, the case carries a curved crystal 25 on its upper face 16 and includes two fine transverse grooves 26 in its lower face 17, these grooves accommodating by lateral sliding the bent ends 27 of a decorative plate 28 of the same curvature as the crystal. This plate 28 conceals a sealed battery hatch 29 and covers, in the example shown here, most of lower face 17 for the purpose of giving the back of the case a particular aesthetic appearance. Of course, plate 28 may have other functions rather than being simply decorative, like for example covering a compartment able to receive any object or a spare battery. The case further includes, in a conventional manner, a clockwork movement 30, a dial 31 and hands 32.

It can be seen in FIG. 8 that hole 13 of one of flanges 17 has a greater cross-section than that of hole 14 of the other flange. Indeed, these two holes 13 and 14 used during the assembly and dismantling of wristwatch 1 have different functions. During assembly, case 2 has to be placed between flanges 7 of support 3, hole 20 of the case having to be aligned with holes 13 and 14 of support 3. It is then that hole 13, with the larger cross-section, receives the bar 33 shown in FIG. 11, which is inserted into the case until it abuts against opposite inner surface 9 in proximity to hole 14. The function of hole 14 is to receive a small tool allowing bar 33 to be forced back in the opposite direction during dismantling, so as to remove it to detach case 2 from support 3.

Figure 9:
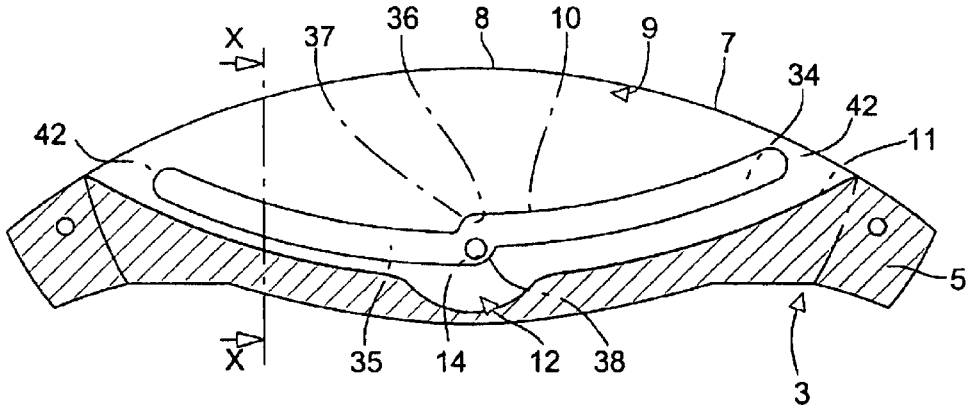
FIG. 9 is a longitudinal cross-section of the support along the line IX—IX of FIG. 8.
Figure 10:
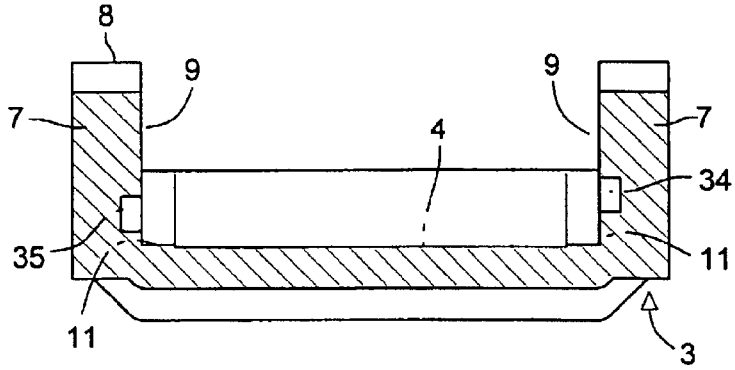
FIG. 10 is a transverse vertical cross-section of the support along the line X—X of FIG. 9.
Figure 11:
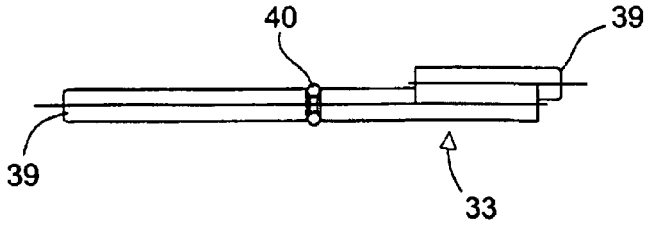
FIG. 11 is a view of the bar establishing the connection between the case and the support shown in FIGS. 8 to 10.

FIG. 9 shows the particular geometry of grooves 10 in this embodiment. These grooves are each formed of two successive sections 34 and 35, substantially parallel to guide surfaces 11 and located at different distances from the latter, thus defining a high section 34 and a low section 35, connected to each other by a vertical break 36 forming an upper stop 37 and a lower stop 38. Grooves 10 are reversed with respect to each other, so that high section 34 of one is located opposite low section 35 of the other and vice versa, as appears in FIG. 10. These grooves 10 receive snugs 39 formed by the ends of bar 33, these snugs being offset with respect to each other in height as is seen in FIG. 11. It should be noted that once bar 33 is housed in case 2, a system equivalent to the use of snugs secured to the case is obtained, the bar being held in hole 20 by friction, for example as a result of an O-ring joint 40.

Figure 4:
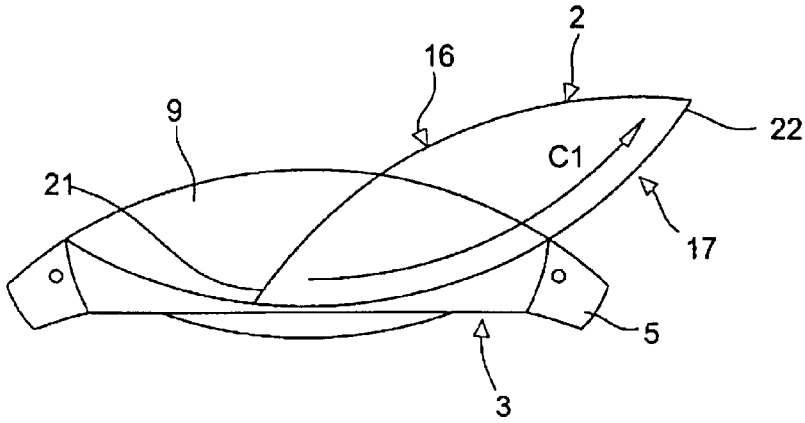
FIG. 4 is a schematic lateral view of the watch in an intermediate sliding position of the case.
Figure 5:
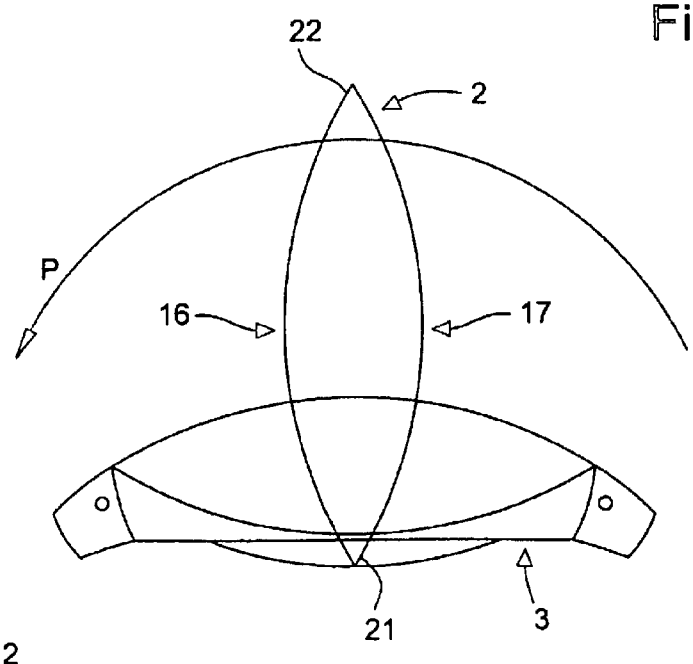
FIG. 5 is a schematic lateral view of the watch during the pivoting phase of the case.
Figure 6:
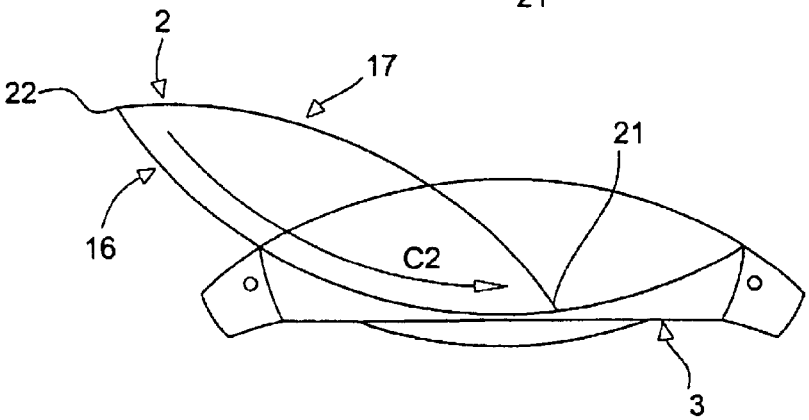
FIG. 6 is a schematic lateral view of the watch, pivoting being completed, prior to the second sliding step of the case.

The turning over of case 2 in support 3 is schematised in FIGS. 4 to 6. When case 2 is mounted in support 3 and is in one of its operating positions, showing for example its upper face 16, as shown in FIG. 1, its small projecting elements 18 are engaged in grooves 10 of support 3 so as to lock it in said position. The user has to exert pressure on case 2 in a substantially parallel direction to wristband 6 in order to release it and be able to slide it as indicated by arrow C1 to bring it into the position of FIG. 4. It will be noted that when case 2 is close to an operating position, it cannot pivot around snugs 39, not only because they are not on the same axis and grooves 10 are also offset in height, but above all because the distance of snugs 39 with respect to support 3 is smaller than that with respect to end 21 of the case. Consequently, case 2 has only a very small clearance in such a position until a support zone 41 of the case, in proximity to the end provided with snugs 39, comes into contact with guide surfaces 11 of the support. Thus, during the sliding step, the user pushes case 2 by exerting pressure close to end 21, in the direction of wristband 6. Support zones 41 slide over guide surfaces 11, until the uppermost snug 39 abuts against upper stop 37 and the lowest snug 39 abuts against lower stop 38. It should be noted that the case may be made to include, on face 16, longitudinal flanges (not shown) on either side of crystal 25, the latter being slightly set back with respect to these flanges and support zones 41, so that it does not come into contact with any element of support 3 during the movement. Case 2 then cannot continue sliding in the same direction. Since end 21 of the case is located above recess 12, pivoting is made possible. Indeed, the user causes end 23 of the case to be raised then completely pivoted, as schematised by arrow P in FIGS. 5 and 6, so that the uppermost snug 39 moves downwards and is located at the level of low section 35 of the corresponding groove, while the lowest snug 39 moves upwards and is located at the level of high section 34 of the corresponding groove. Since the case is in the position of FIG. 6, it can effect a second sliding travel in the same direction, as indicated by arrow C2 of FIG. 6, via the action of pressure by the user close to its end 23. The second operating position, in which lower decorative face 17 of the case is visible, is reacted when snugs 39 reach a stop against ends 42 of grooves 10 and the small projecting elements 18 are fitted into the other ends of grooves 10, thus locking case 2.

In order to return to the first operating position in which upper face 16 is visible, the same series of operations need only be effected in the opposite direction, since snugs 39 have changed side with respect to support 3 of the watch.

One advantage of such a structure is that it prevents case 2 being able to be slid from one end 42 of grooves 10 to the other, without pivoting at stops 37 and 38. Moreover, given the great height of flanges 7 of the support in the vicinity of recess 12, there is no possibility of case 2 reaching a position without lateral support. Further, the respective shapes of case 2 and support 3 provide wristwatch 1 with aesthetic advantages due to the continuity of the shapes, the symmetry and fluidity of the complete movement of case 2. This movement is preferably made in the direction of wristband 6 for aesthetic reasons and for originality, but it could also be made to occur laterally. When the movement occurs in the direction of the wristband, it is to be noted that the pivoting of the case at the centre of the support means that the recesses at the ends, as described in the aforecited prior art, can be omitted, which means a significant saving of space in proximity to the points where the wristband is attached. It should also be noted that guide surfaces 11 of support 3 have an additional function, which is preventing crystal 25 from coming into contact with support 3 and thus being damaged. The particular and complementary shapes of the case and the support give the watch another advantage which is good resistance to shocks and wear by friction, since, as appears in FIGS. 1 to 3, the watch does not have any projecting parts. This means that an embodiment in inexpensive moulded plastic as well as metal can be used.

Figure 12:
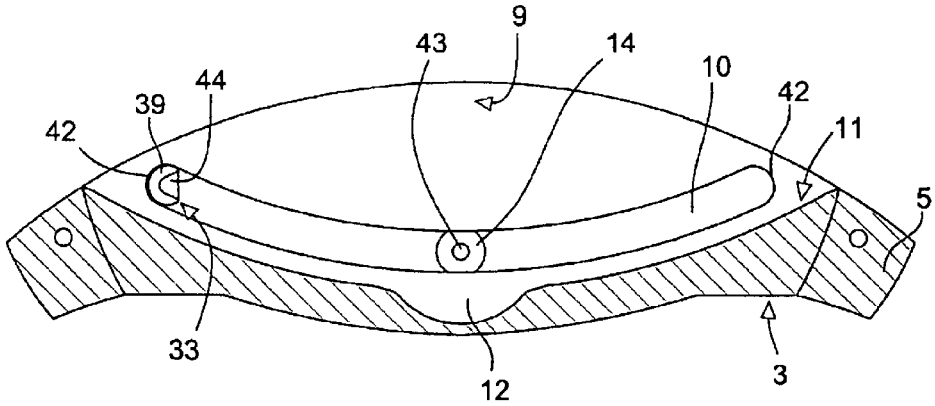
FIG. 12 is a similar view to that of FIG. 9, in an embodiment for which each stop is located substantially on the axis of the groove and each snug includes a recess.

Another embodiment is shown in FIG. 12, in which grooves 10 each include only one section, closed at its two ends 42, and each stop 43 is formed by a cylindrical stub located substantially on the longitudinal axis of the corresponding groove 10, preferably at an equal distance from ends 42. Snugs 39 are at the same distance from guide surfaces 11 and are carried by bar 33, formed here by a cylinder which is longitudinally truncated. Thus, once bar 33 is in place in hole 20 (visible in FIG. 3) of case 2, of complementary shape, it cannot turn. Each snug 39 includes a lateral recess 44, able to accomodate the corresponding stop 43.

The shape of case 2, guide surfaces 11 and rounded transverse recess 12 of support 3 are the same as in the embodiment according to FIGS. 1 to 10. Consequently, the overall turning movement sequence of case 2 in support 3 is unchanged with respect to the preceding description. After a first sliding travel from a first operating position, each snug 39 abuts against the corresponding stop 43 and covers it. It is only at this place that case 2 can pivot, by pivoting snugs 39 around stops 43, because of the existence of guide surfaces 11 and recess 12, as defined previously. Once case 2 has pivoted, each snug 39 can effect the second sliding travel until it abuts against the second closed end 42 of the corresponding groove 10, where case 2 reaches its other operating position.

Figure 13:
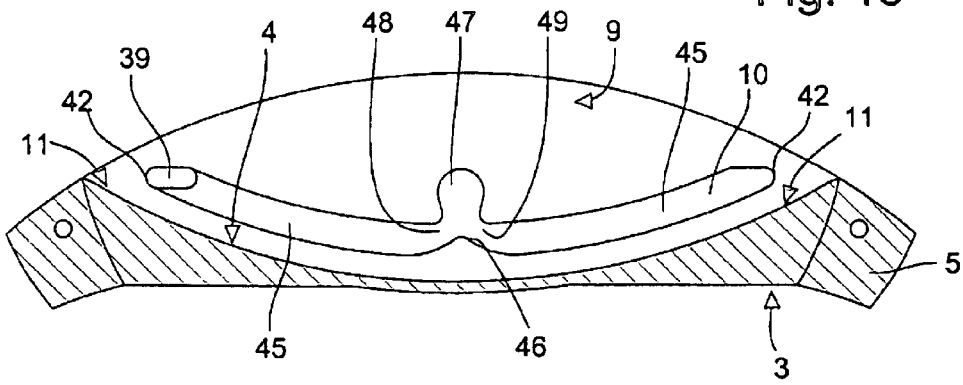
FIG. 13 is a similar view to that of FIG. 9, in an embodiment for which each groove includes a recess facing the corresponding stop, the snugs having an elongated shape.

Another possible embodiment appears in FIG. 13. Snugs 39 of the case have an oblong cross-section, preferably formed of two parallel rectilinear faces connected by two portions of a circle, and are of greater length than the height of grooves 10 of support 3. The grooves each include two sections 45 at the same distance from guide surfaces 11, closed at their ends 42 and separated by a rising projecting stop 46, preferably located at an equal distance from ends 42 of the groove. A recess 47 of rounded shape and of greater dimension than the length of snugs 39 is located facing each stop 46, junctions 48 and 49 between sections 45 and recess 47 forming necks through which snugs 39 can pass. Preferably, longitudinal guide surfaces 11 of support 3 are still present in the example shown, but are continuous from one end of bottom 4 of support 3 to the other.

The turning movement of case 2 remains overall the same as previously described, with however a significant difference as regards snug 39 passing over stop 46. Indeed, each snug 39 starting from end 42 of a first section 45, as shown in FIG. 13 for example, effects the first sliding travel in the corresponding groove 10 without being able to pivot therein, given their respective shape, until it abuts against stop 46 when case 2 then stops sliding. In order to continue its movement, snug 39 has to follow the upper contour of stop 46, i.e. it pivots while being lifted up, passes through junction 48 to penetrate recess 47 where it can pivot sufficiently for the side of snug 39 which first entered recess 47 to be last to come out again through junction 49, to enter second section 45. Indeed, when the snug is in recess 47, its distance from the bottom of support 3 is greater than its distance from end 21 of case 2, which allows case 2 to turn over at this point in order to show its second face, and to effect the second sliding travel until snug 39 abuts against end 42 of second section 45, thus defining an operating position.

It should be noted that the shape and dimensions of snug 39 are sufficient in this embodiment, to prevent case 2 from pivoting outside recess 47. However, guide surfaces 11 on support 3, on which support zones 41 of case 2 can slide in the sliding steps, reinforce the device by also preventing case 2 from pivoting during the sliding steps of snugs 39 and thus relieve the strain exerted on said snugs.

This variant, with or without guide surfaces 11, allows the previously described rounded transverse recess 12 to be omitted from support 3, which saves space in height in the support and thus involves a reduction in the thickness of wristwatch 1.

Multiple applications may be imagined for wristwatch 1 with the reversible case according to the invention, whether it is made of moulded plastic material or metal. Indeed, thus use of a decorative plate covering one of the faces of the case and able to conceal a compartment was described, but the case may also be made to include, in place of the plate, a second analogue or digital display used to display, for example, the time of day, a second time zone, possibly using a second movement, measured times, or any other type of information.

What is claimed is:

1. A wristwatch including a support attached to a wristband and a case comprising two faces, a clockwork movement and display means, the case being mounted on the support so as to be able to slide and turn over to show respectively one or other of its faces in two operating positions, the watch including means for holding the case in its two operating positions, the support comprising a bottom and two parallel inner surfaces each including a longitudinal groove having closed ends, the case including, facing said inner surfaces, two parallel lateral walls each having a snug able to slide in a corresponding one of said grooves of the support, each of said grooves including at least one stop, disposed at a distance from its ends, the effect of each said stop being to define a stop zone for the corresponding snug, after a first sliding travel of said snug from one end of the groove, to let said case pivot about said snug to turn over said case, before said snug performs a second sliding travel to the other end of the groove, the watch further including means for preventing the case from pivoting while the snugs are situated anywhere alone said grooves except in the stop zones, each said stop zone thus defining a case pivoting zone.

2. A wristwatch according to claim 1, wherein said means for preventing the case from pivoting are formed by at least a guide surface on the support, on which a support zone of the case can rest while sliding.

3. A wristwatch according to claim 2, wherein each of said grooves includes two stops, each of said stops corresponding to a different sliding direction of the case.

4. A wristwatch according to claim 3, wherein each of said grooves is formed of two successive sections, substantially parallel to said guide surface and located at different distances from the latter, thus defining a high section and a low section of said groove, said sections being connected to each other by a vertical break which forms said stops.

5. A wristwatch according to claim 4, wherein the snugs of the case are offset with respect to each other in height, said grooves being arranged so that the high section of one is located facing the low section of the other and vice versa.

6. A wristwatch according to claim 1, wherein each of said grooves includes two stops, each of said stops corresponding to a different sliding direction of the case.

7. A wristwatch according to claim 6, wherein said means for preventing the case from pivoting are formed by at least a guide surface on said support bottom, on which a support zone of the case can rest while sliding, and wherein each of said grooves is formed of two successive sections, substantially parallel to said guide surface and located at different distances from the latter, thus defining a high section and a low section of said groove, said sections being connected to each other by a vertical break which forms said stops.

8. A wristwatch according to claim 7, wherein the snugs of the case are offset with respect to each other in height, said grooves being arranged so that the high section of one is located facing the low section of the other and vice versa.

9. A wristwatch according to claim 1, wherein each of said grooves includes a single stop located substantially at mid-height of the groove, each of the snugs of the case including a recess such that after said first sliding travel, each stop penetrates the recess of the corresponding snug to define therein a pivoting axis for the case, so that the snugs can only continue sliding after having pivoted around the stop.

10. A wristwatch according to claim 2, wherein each of said grooves includes a single stop located substantially at mid-height of the groove, each of the snugs of the case including a recess such that after said first sliding travel, each stop penetrates the recess of the corresponding snug to define therein a pivoting axis for the case, so that the snugs can only continue sliding after having pivoted around the stops.

11. A wristwatch according to claim 1, wherein each of said stops projects over one of both sides of said corresponding groove, a recess being provided on the opposite side of the groove, facing the stop, to allow the corresponding snug to pass over the stop during pivoting.

12. A wristwatch according to claim 2, wherein each of said stops projects over one of both sides of said corresponding groove, a recess being provided on the opposite side of the groove, facing the stop, to allow the corresponding snug to pass over the stop during pivoting.

13. A wristwatch according to claim 1, wherein each of said grooves of the support includes a recess facing the corresponding stop, each of said snugs of the case having an elongated cross-section, of greater length than the height of the groove, so that the case can pivot only by penetrating said recess.

14. A wristwatch according to claim 1, wherein the sliding of the case with respect to the support occurs in a substantially parallel direction to the direction of the wristband.

15. A wristwatch according to claim 3, wherein the sliding of the case with respect to the support occurs in a substantially parallel direction to the direction of the wristband.

16. A wristwatch according to claim 5, wherein the sliding of the case with respect to the support occurs in a substantially parallel direction to the direction of the wristband.

17. A wristwatch according to claim 6, wherein the sliding of the case with respect to the support occurs in a substantially parallel direction to the direction of the wristband.

18. A wristwatch according to claim 10, wherein the sliding of the case with respect to the support occurs in a substantially parallel direction to the direction of the wristband.

19. A wristwatch according to claim 12, wherein the sliding of the case with respect to the support occurs in a substantially parallel direction to the direction of the wristband.

20. A wristwatch according to claim 13, wherein the sliding of the case with respect to the support occurs in a substantially parallel direction to the direction of the wristband.

* * * * *

UNITED STATES PATENT AND TRADEMARK OFFICE

CERTIFICATE OF CORRECTION

PATENT NO. : 6,738,317 B2
DATED : May 18, 2004
INVENTOR(S) : Augustin Nussbaum

It is certified that error appears in the above-identified patent and that said Letters Patent is hereby corrected as shown below:

Column 6,
Line 25, delete “alone”, and insert -- along --.

Signed and Sealed this

Ninth Day of November, 2004

JON W. DUDAS
*Director of the United States Patent and Trademark Office*